US007931217B2

(12) United States Patent
Matsusaka et al.

(10) Patent No.: US 7,931,217 B2
(45) Date of Patent: Apr. 26, 2011

(54) FUEL INJECTION VALVE

(75) Inventors: Noboru Matsusaka, Kariya (JP); Yoshitomo Oguma, Hekinan (JP); Katsunori Furuta, Obu (JP)

(73) Assignee: Denso Corporation, Kariya (JP)

( * ) Notice: Subject to any disclaimer, the term of this patent is extended or adjusted under 35 U.S.C. 154(b) by 260 days.

(21) Appl. No.: 12/264,279

(22) Filed: Nov. 4, 2008

(65) Prior Publication Data

US 2009/0127355 A1 May 21, 2009

(30) Foreign Application Priority Data

Nov. 20, 2007 (JP) ..... 2007-300559

(51) Int. Cl.
*F02M 51/00* (2006.01)

(52) U.S. Cl. ..... 239/585.1; 239/585.3; 239/585.5; 239/900; 251/129.16

(58) Field of Classification Search ..... 239/585.1, 239/585.5; 269/585.3, 900; 251/129.16
See application file for complete search history.

(56) References Cited

U.S. PATENT DOCUMENTS

| | | | | |
|---|---|---|---|---|
| 5,887,798 | A | 3/1999 | Ohta et al. | |
| 5,915,626 | A * | 6/1999 | Awarzamani et al. | 239/135 |
| 6,481,646 | B1 * | 11/2002 | Hornby | 239/585.1 |
| 6,508,418 | B1 * | 1/2003 | Fochtman et al. | 239/585.4 |
| 6,814,311 | B2 | 11/2004 | Kobayashi et al. | |
| 6,976,381 | B2 | 12/2005 | Koshizaka et al. | |
| 7,051,960 | B2 | 5/2006 | Oguma | |
| 2006/0255185 | A1 * | 11/2006 | Cristiani et al. | 239/533.7 |

FOREIGN PATENT DOCUMENTS

| | | |
|---|---|---|
| JP | 58-79069 | 5/1983 |
| JP | 07-189852 | 7/1995 |
| JP | 2003-129916 | 5/2003 |
| JP | 2006-043776 | 2/2006 |
| JP | 2006-047641 | 2/2006 |

OTHER PUBLICATIONS

Japanese Office Action dated Oct. 6, 2009, issued in corresponding Japanese Application No. 2007-300559, with English translation.
U.S. Application No. 12/264,278, Matsusaka et al., filed Nov. 4, 2008.

* cited by examiner

*Primary Examiner* — Dinh Q Nguyen
(74) *Attorney, Agent, or Firm* — Nixon & Vanderhye PC

(57) ABSTRACT

A coil is located radially outside of a pipe. An inner connector is located radially inside of the pipe. A moving core is located radially inside of the pipe and opposed to the inner connector. A housing surrounds both an outer circumferential periphery of the coil and one axial end of the coil. A cover surrounds an other axial end of the coil. An outer connector leads fuel into the pipe. The pipe and the cover are integrally formed and one single component as a with-cover pipe member. The inner connector and the outer connector are integrally formed and an other single component as a connector member. The connector member is partially inserted in the axial direction radially inside the pipe of the with-cover pipe member.

12 Claims, 3 Drawing Sheets

FUEL INJECTION VALVE

CROSS REFERENCE TO RELATED APPLICATIONS

This application is based on and incorporates herein by reference Japanese Patent Application No. 2007-300559 filed on Nov. 20, 2007.

FIELD OF THE INVENTION

The present invention relates to a fuel injection valve for an internal combustion engine.

BACKGROUND OF THE INVENTION

For example, U.S. Pat. No. 7,051,960 B2 (JP-A-2006-22721) discloses a fuel injection valve for an internal combustion engine. Conventionally, as shown in FIG. 3, a fuel injection valve (injector) 91 includes a pipe 911, an inner connector 921, a moving core 923, a needle 940, and an outer connector 922. The inner connector 921 is located around the inner circumferential periphery of the pipe 911. The moving core 923 is opposed to the inner connector 921 in the axial direction and configured to be drawn toward the inner connector 921 by exerted with magnetic attraction force generated between the inner connector 921 and the moving core 923. The needle 940 as a valve element is movable together with the moving core 923 in the axial direction and configured to open and close nozzle holes 934 to inject fuel. The outer connector 922 is configured to lead fuel into the pipe 911 from the outside of the outer connector 922.

In the present conventional structure shown in FIG. 3, the pipe 911 of the injector 91 has the inner circumferential periphery accommodating the inner connector 921, the moving core 923, and the needle 940. The inner connector 921 is located at the side of a rear end of the pipe 911. The moving core 923 and the needle 940 are located at the side of a tip end side of the pipe 911 with respect to the inner connector 921. The outer connector 922 is partially inserted into the rear end of the pipe 911. A coil 951 is provided around the outer circumferential periphery of the pipe 911 and configured to generate a magnetic field when being energized. A housing 913 surrounds the outer circumferential periphery of the coil 951 and one axial end of the coil 951 in the axial direction, thereby supporting the coil 951. A cover 960 surrounds the other axial end of the coil 951 in the axial direction. That is, in the present structure of the injector 91 shown in FIG. 3, the coil 951 is enclosed by the pipe 911, a cover 912, and the housing 913. In the present structure, the nozzle holes 934 are located at the tip end side, and the opposite side of the nozzle holes 934 corresponds to the rear end side.

However, the fuel injection valve (injector) 91 of FIG. 3 has the following problems. A large number of components of the injector 91 need to be inserted and accommodated inside the inner circumferential periphery of the pipe 911. In addition, components of the injector 91 need to be attached to the outer circumferential periphery of the pipe 911. Accordingly, productivity of the injector is impaired due to increase and complication in the assembling process and the like. In addition, the present problem becomes further remarkable as the number of components increases, and consequently productivity is further impaired.

SUMMARY OF THE INVENTION

In view of the foregoing and other problems, it is an object of the present invention to produce a fuel injection valve having a simple structure and excellent in productivity and quality.

According to one aspect of the present invention, a fuel injection valve comprises a pipe being substantially in a cylindrical shape. The fuel injection valve further comprises a coil located radially outside of the pipe and configured to generate a magnetic field when being energized. The fuel injection valve further comprises an inner connector located radially inside of the pipe. The fuel injection valve further comprises a moving core located radially inside of the pipe and opposed to the inner connector, the moving core configured to be attracted to the inner connector by magnetic attraction force generated between the moving core and the inner connector. The fuel injection valve further comprises a valve element movable together with the moving core in an axial direction and configured to open and close a nozzle hole for injecting fuel. The fuel injection valve further comprises a housing surrounding both an outer circumferential periphery of the coil and one axial end of the coil, which is at one end side in the axial direction. The fuel injection valve further comprises a cover surrounding an other axial end of the coil, which is at an other end side in the axial direction. The fuel injection valve further comprises an outer connector configured to lead fuel from an outside of the pipe into the pipe. The pipe and the cover are integrally formed and one single component as a with-cover pipe member. The inner connector and the outer connector are integrally formed and an other single component as a connector member. The connector member is partially inserted in the axial direction radially inside the pipe of the with-cover pipe member and connected with the pipe.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF PREFERRED EMBODIMENTS

First Embodiment

Figure 1:
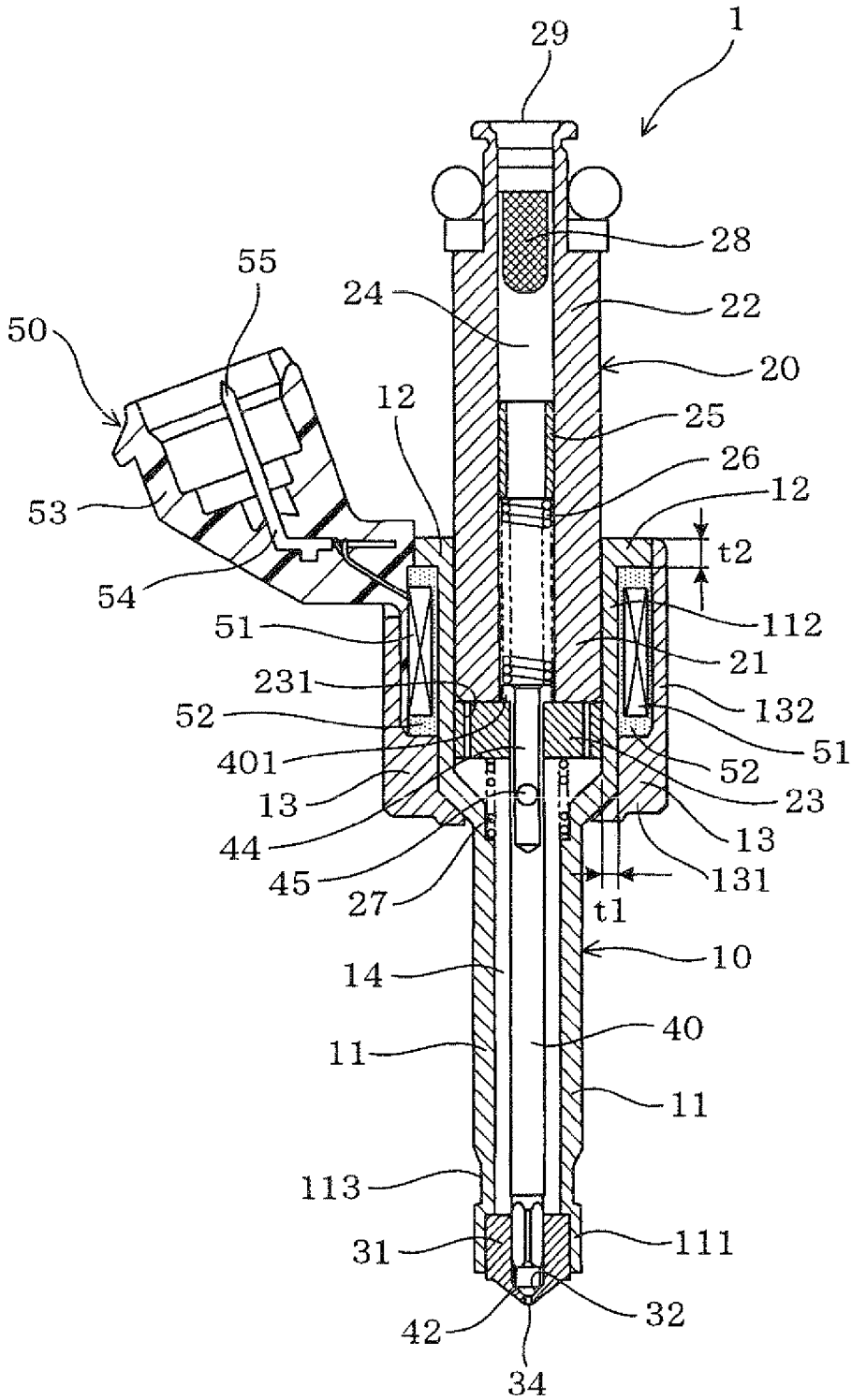
FIG. 1 is a sectional view showing an injector according to a first embodiment.

A fuel injection valve (injector) according to the present embodiment is described with reference to drawings. As shown in an FIG. 1, an injector 1 in the present embodiment is applied to a direct-injection gasoline engine. The application of the injector 1 is not limited to the direct-injection gasoline engine and may be applied to a premix gasoline engine or a diesel engine. The injector 1 is mounted to an engine head (not shown) when being applied the direct-injection gasoline engine. In the present embodiment, the injector 1 has a tip end sides to which nozzle holes 34 are provided, and a rear end side at the opposite side of the tip end side.

The injector 1 includes a with-cover pipe member 10 including a pipe 11 and a cover 12. The pipe 11 is substantially in a cylindrical shape. The cover 12 is projected from a rear end of the pipe 11 in a radial direction. That is, in the present embodiment, the pipe 11 and the cover 12 are integrated to be the with-cover pipe member 10 as one component (single component). The with-cover pipe member 10 is formed from a magnetic material such as electromagnetic stainless steel.

A coil assembly 50 is provided around the outer circumferential periphery of the pipe 11 of the with-cover pipe member 10. The coil assembly 50 is integrally formed of a coil 51, a mold element 52, and an electrical connector 53. The coil 51 is covered with the mold element 52, which is formed of resin. The coil 51 is substantially in a cylindrical shape and has the outer circumferential periphery and the inner circumferential periphery both being covered with the mold element 52. The coil 51 surrounds throughout the outer circumferential periphery of the pipe 11 in the circumferential direction. The mold element 52 and the electrical connector 53 are integrally formed from resin. The coil 51 is connected with a terminal 55 of the electrical connector 53 via a wiring member 54.

The coil 51 has the outer circumferential periphery and the tip end both provided with a housing 13. The housing 13 includes a housing bottom portion 131 and a housing outer end 132. The housing bottom portion 131 is located around the outer circumferential periphery of the pipe 11 of the with-cover pipe member 10. The housing outer end 132 is raised in the axial direction from the outer end of the housing bottom portion 131. The housing 13 is formed from a magnetic material such as electromagnetic stainless steel. The cover 12 of the with-cover pipe member 10 is provided at the side of the rear end of the coil 51. The cover 12 surrounds the rear end of the coil 51 and is abutted to the housing bottom portion 131 in the axial direction. The coil 51, which is covered with the mold element 52, is surrounded by the pipe 11 of the with-cover pipe member 10, the cover 12, the housing bottom portion 131 of the housing 13, and the housing outer end 132. That is, the coil 51 is substantially surrounded by the with-cover pipe member 10 and the two components of the housing 13.

The pipe 11 of the with-cover pipe member 10 has a tip-end-side portion, which accommodates a needle 40. The tip-end-side portion of the pipe 11 has a fitting portion 113, which is dented in the radial direction and configured to be fitted with a sealing member (not shown), which is substantially in a ring shape. The sealing member is configured to seal between the injector 1 and the engine head when the injector 1 is mounted to the engine head. The pipe 11 of the with-cover pipe member 10 has a rear-side portion at the rear side of the fitting portion 113, and the rear-side portion has the thickness t1. The cover 12 has the thickness t2. The thicknesses t1, t2 satisfy $t1 \leqq t2$. In the present embodiment, the thickness t1 satisfies t1=1 mm, and the cover thickness t2 satisfies t2=1.5 mm.

The pipe 11 of the with-cover pipe member 10 has a tip end 111, which accommodates a valve body 31. The valve body 31 is substantially in a cylindrical shape, for example, and fixed to the tip end 111 of the pipe 11 by press-fitting, welding, or the like. The valve body 31 has an inner wall surface, which is substantially in a conical shape and reduces in the inner diameter toward the tip end thereof. The inner wall surface of the valve body 31 defines a valve seat 32. The nozzle holes 34 are provided in the tip end of the valve body 31. The nozzle holes 34 communicate the inside of the valve body 31 with the outside of the valve body 31. The nozzle holes 34 may be a single hole or multiple hoes.

The needle 40 as a valve element and a moving core 23 are accommodated around the inner circumferential periphery of the pipe 11 of the with-cover pipe member 10. The moving core 23 is axially movable around the inner circumferential periphery of the pipe 11. The moving core 23 is substantially in a cylindrical shape and formed from a magnetic material such as electromagnetic stainless steel. The moving core 23 has a through hole 231, which extends substantially in the axial direction. The through hole 231 is configured to therethrough communicate fuel so as to restrict the moving core 23 from sticking an inner connector 21 when the moving core 23 is attracted to the inner connector 21. In the present structure, the needle 40 can be smoothly manipulated to open and close the nozzle holes.

The needle 40 is located around the inner circumferential periphery of the pipe 11 and substantially coaxial with the valve body 31. The needle 40 has a tip end defining a seal portion 42. The seal portion 42 is configured to be seated to the valve seat 32 of the valve body 31. The needle 40 is substantially in a cylindrical shape and has an inner circumferential periphery defining a needle fuel passage 44. Fuel flows from the needle fuel passage 44 inside the needle 40 into a pipe fuel passage 14 outside the needle 40 through a fuel hole 45. The needle 40 has a rear end, which is fixed to the moving core 23. In the present structure, the moving core 23 and the needle 40 are integrally movable back and forth in the axial direction. The moving core 23 and the needle 40 may be separate components.

The pipe 11 of the with-cover pipe member 10 has a rear end 112 provided with a connector member 20. The connector member 20 includes the inner connector 21 and an outer connector 22. The inner connector 21 is located around the inner circumferential periphery of the pipe 11. The outer connector 22 is configured to lead fuel into the pipe 11 from the outside of the outer connector 22. In the present embodiment, the inner connector 21 and the outer connector 22 are integrally formed to be the connector member 20 as the one component (single component). The connector member 20 is partially inserted in the axial direction around the inner circumferential periphery of the pipe 11 of the with-cover pipe member 10 and connected with the pipe 11. The connector member 20 is substantially in a cylindrical shape and formed from a magnetic material such as electromagnetic stainless steel.

An adjusting pipe 25 is press-fitted into the inner circumferential periphery of the inner connector 21. The outer connector 22 has a rear end defining a fuel inlet 29. The fuel inlet 29 is supplied with fuel by a fuel pump (not shown) from a fuel tank. Fuel is supplied to the fuel inlet 29, and the fuel flows into a connector fuel passage 24, which is defined by the inner circumferential periphery of the outer connector 21, after passing through a filter member 28. The filter member 28 is provided inside the outer connector 21. The filter member 28 removes foreign matter contained in the fuel.

The needle 40 has a rear end, which is in contact with a first spring 26 as a biasing member. The first spring 26 has one end, which is in contact with the rear end of the needle 40. The first spring 26 has the other end, which is in contact with the adjusting pipe 25. The moving core 23 has a tip end, which is in contact with a second spring 27 as a biasing member. Each of the biasing members is not limited to the spring and may be a blade spring, a gas damper, a liquid damper, or the like.

As described above, the adjusting pipe 25 is press-fitted to the inner circumferential periphery of the inner connector 21. The load exerted from the first spring 26 is controlled by adjusting the press-fitted margin of the adjusting pipe 25. The first spring 26 is extendable in the axial direction. In the present structure, the moving core 23 and the needle 40 are integrally biased from the first spring 26 such that the seal portion 42 is seated to the valve seat 32. Simultaneously, the moving core 23 is biased from the second spring 27 such that the rear end of the moving core 23 makes contact with a contact surface 401 of the needle 40.

Next, an operation of the injector 1 is described.

Referring to FIG. 1, when the coil 51 is de-energized, the inner connector 21 of the connector member 20 and the moving core 23 do not cause magnetic attraction force therebetween. In the present condition, the moving core 23 is biased by the first spring 26 and moved away from the inner connector 21. Consequently, when the coil 51 is de-energized, the seal portion 42 of the needle 40, which is integrated with the moving core 23, is seated to the valve seat 32 to be in a closed state. Therefore, fuel is not injected from the nozzle holes 34.

When the coil 51 is energized, the coil 51 generates a magnetic field to cause magnetic flux through a magnetic circuit defined in the housing 13, the pipe 11, the moving core 23, the inner connector 21, and the cover 12. Thus, the inner connector 21 and the moving core 23, which are apart from each other, generate magnetic attraction force therebetween. When the magnetic attraction force, which is generated between the inner connector 21 and the moving core 23, becomes greater than the biasing force of the first spring 26, the moving core 23 and the needle 40 integrally move toward the inner connector 21. Consequently, the seal portion 42 of the needle 40 is lifted from the valve seat 32 to be in an opened state.

Fuel flows into the fuel inlet 29 and passes through the filter member 28, the connector fuel passage 24 inside the outer connector 22, the passage inside the adjusting pipe 25 and the inner connector 21, and the needle fuel passage 44 inside the needle 40. The fuel flows into the pipe fuel passage 14 outside the needle 40 through the fuel hole 45. The fuel flowing into the pipe fuel passage 14 passes through the gap between the valve body 31 and the needle 40, which is lifted from the valve seat 32, and the fuel is injected from the nozzle holes 34.

When the coil 51 is de-energized, the magnetic attraction force between the inner connector 21 and the moving core 23 disappears. In the present operation, the moving core 23 and the needle 40 integrally move to the opposite side of the inner connector 21 by being exerted with the biasing force of the first spring 26. Consequently, the seal portion 42 of the needle 40 is again seated to the valve seat 32 to be in the closed state. Thus, fuel injection from the nozzle holes 34 is terminated.

Next, a manufacturing process of the injector 1 is described.

First, the valve body 31 is attached to the tip end 111 of the pipe 11 of the with-cover pipe member 10. Afterwards, the moving core 23 and the needle 40 are accommodated inside the pipe 11. The moving core 23 is integrated with the needle 40 by, for example, press-fitting or welding in advance.

Subsequently, the coil assembly 50, which includes the coil 51, the mold element 52, the electrical connector 53, is attached to the outer circumferential periphery of the pipe 11 of the with-cover pipe member 10. At this time, the coil 51 is located such that the rear end side of the coil 51, which is embedded in the mold element 52, is covered the cover 12 of the with-cover pipe member 10. And subsequently, the housing 13 is attached to the with-cover pipe member 10. As illustrated in FIG. 1, the cover 12 is abutted to the housing bottom portion 131 in the axial direction. At this time, the housing 13 is attached such that the outer circumferential periphery and the tip end of the coil 51 are respectively covered with the housing outer end 132 and the housing bottom portion 131.

And subsequently, the connector member 20 is press-fitted into the inner circumferential periphery of the with-cover pipe member 10 from the rear end of the with-cover pipe member 10. The first spring 26 is inserted into the cavity defined by the inner circumferential periphery of the inner connector 21 of the connector member 20, and subsequently the adjusting pipe 25 is press-fitted to the inner circumferential periphery of the inner connector 21. Furthermore, the filter member 28 is attached to the inside of the outer connector 22 of the connector member 20. Thus, the manufacturing of the injector 1 is completed.

Next, an operation effect of the injector (fuel injection valve) 1 according to the present embodiment is described. In the injector 1 according to the present embodiment, the pipe 11 and the cover 12 are integrally formed to be the one component (single component) as the with-cover pipe member 10. In addition, the inner connector 21 and the outer connector 22 are integrally formed to be the one component (single component) as the connector member 20. Therefore, in the present structure, the number of components of the injector can be reduced, compared with the conventional structures in which the pipe 11 and cover 12 are separately formed to be multiple components, and/or the inner connector 21 and the outer connector 22 are separately formed to be multiple components. Thus, the structure of the injector 1 can be simplified, and therefore productivity and quality of the injector 1 can be enhanced.

More specifically, a manufacturing process such as aligning of one component relative to another component in the axial direction and fixing of one component to another component by welding or the like can be reduced by the reduction of the number of components. Therefore, man power for manufacturing the injector can be reduced, so that productivity of the injector can be enhanced. As a whole, a joint portion of components can be reduced. Thus, strength of the injector 1 can be enhanced, compared with the conventional structure, and therefore reliability of the injector 1 can be further enhanced.

Figure 3:
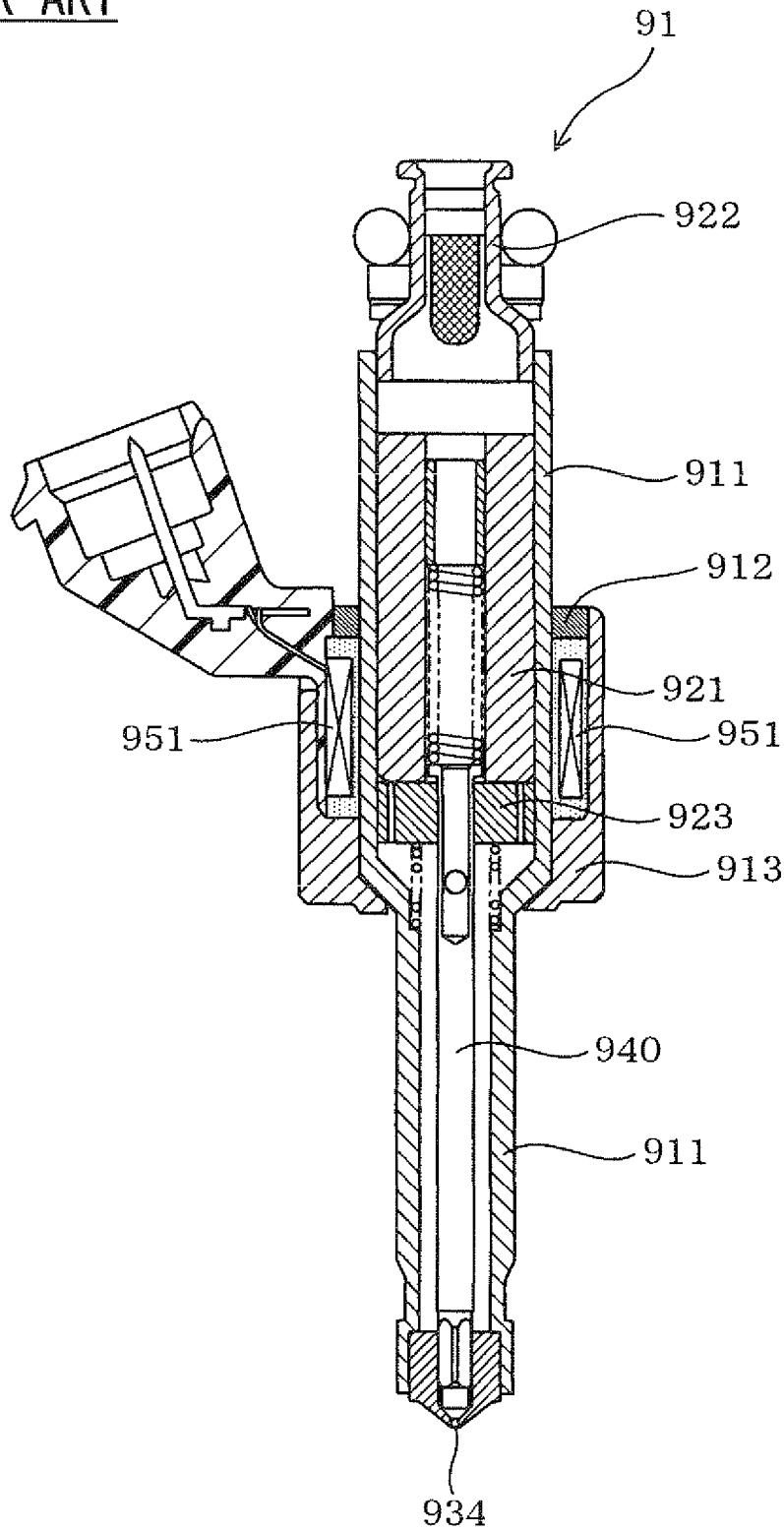
FIG. 3 PRIOR ART
FIG. 3 is an injector according to a prior art.

Further, it is obvious from FIG. 1 (present embodiment) and FIG. 3 (prior art), the components are not simply integrally formed to the one components in the present embodiment. In the present embodiment, the conventional pipe 911 is once divided, and the tip-end-side portion of the pipe 911 and the cover 912 are integrated into the one component as the with-cover pipe member 10. In addition, the rear-side portion of the pipe 911, the inner connector 921, and the outer connector 922 are integrated into the one component as the connector member 20. Thus, the structure of the injector is totally changed so as to reduce the number of the components. Therefore, manufacture of each component is facilitated. Furthermore, in the present structure, the connector member 20 is inserted in the axial direction into the inner circumferential periphery of the with-cover pipe member 10 and fixed to the with-cover pipe member 10. Therefore, assembling work of the injector is also facilitated. Thus, productivity and quality of the injector 1 can be enhanced.

Furthermore, according to the present embodiment, the pipe 11 and the cover 12 are integrally formed to be the one component as the with-cover pipe member 10. In addition, the coil 51 is surrounded by the two components including the with-cover pipe member 10 and the housing 13. Thus, the structure of the injector 1 can be simplified, and therefore productivity of the injector 1 can be enhanced. Further, the with-cover pipe member 10 can be coaxially aligned relative to the housing 13 by simply adjusting the position of the housing 13 in the axial direction relative to the outer circumferential periphery of the pipe 11 of the with-cover pipe member 10. That is, the position of the outermost peripheral surface of the housing 13 in the axial direction can be easily adjusted in accordance with the alignment between the two components including the with-cover pipe member 10 and the housing 13. Therefore, dimensional control at the time of mounting the injector 1 to the engine or the like can be facilitated, and thereby mountability of the injector 1 can be enhanced. Further, in the present structure, accuracy of the location of the injector 1 when mounted to the engine can be enhanced, and hence product quality such as the fuel injection angle of the injector 1 can be enhanced.

As described above, according to the present embodiment, productivity and quality of the injector (fuel injection valve) can be enhanced with a simple structure.

Second Embodiment

In the present embodiment, estimation results of static attraction force of the injector (fuel injection valve) are described. Here, a magnetic circuit model of the injector having the same structure as that in the first embodiment is defined. Further, values of static attraction force having different thicknesses t2 (FIG. 1) of the with-cover pipe member are obtained by conducting a simulation using the magnetic circuit model. In the simulation, magnetomotive force is set at 500 AT (500 A) and 1800 AT (1800 A).

Referring to FIG. 1, the static attraction force is equivalent to magnetic attraction force generated between the inner connector 21 and the moving core 23 when magnetic flux passes through the magnetic circuit including the housing 131 the pipe 11, the moving core 23, the inner connector 21, the and cover 12 in response to energization of the coil 51.

Figure 2:
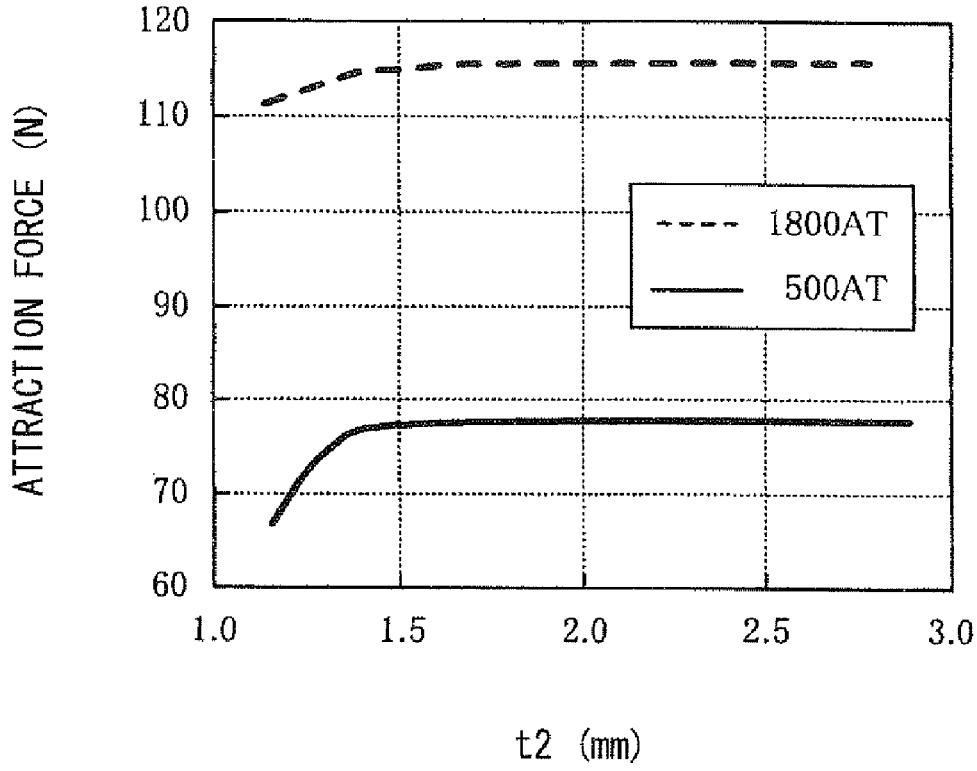
FIG. 2 is a graph showing a relationship between a cover thickness t2 and static attraction force, according to a second embodiment.

FIG. 2 depicts the result of the simulation. FIG. 2 depicts a relationship between the cover thickness t2 (mm) and the static attraction force (N). It is obvious from FIG. 2, in the case where the magnetomotive force is 500 AT, and the cover thickness t2 is greater or equal to 1.5 mm, stable static attraction force of about 75N can be obtained. Further, in the case where the magnetomotive force is 1800 AT, and the cover thickness t2 is greater or equal to 1.5 mm, stable static attraction force of about 115N can be obtained. Therefore, the cover thickness t2 is preferably greater or equal to 1.5 mm.

In the above embodiments, the with-cover pipe member 10 may be formed by press-forming or forging. In the above embodiments, the cover 12 extends in the radial direction from the outer circumferential periphery of the pipe 11. The cover 12 extends in the circumferential direction around the outer circumferential periphery of the pipe 11. The cover 12 may be substantially in a collar shape.

It should be appreciated that while the processes of the embodiments of the present invention have been described herein as including a specific sequence of steps, further alternative embodiments including various other sequences of these steps and/or additional steps not disclosed herein are intended to be within the steps of the present invention.

The above structures of the embodiments can be combined as appropriate. Various modifications and alternations may be diversely made to the above embodiments without departing from the spirit of the present invention.

What is claimed is:

1. A fuel injection valve comprising:

a pipe being substantially in a cylindrical shape;

a coil located radially outside of the pipe and configured to generate a magnetic field when being energized;

an inner connector located radially inside of the pipe;

a moving core located radially inside of the pipe and opposed to the inner connector, the moving core configured to be attracted to the inner connector by magnetic attraction force generated between the moving core and the inner connector;

a valve element movable together with the moving core in an axial direction and configured to open and close a nozzle hole for injecting fuel;

a housing surrounding both an outer circumferential periphery of the coil and one axial end of the coil, which is at one end side in the axial direction;

a cover surrounding an other axial end of the coil, which is at an other end side in the axial direction;

an outer connector configured to lead fuel from an outside of the pipe into the pipe; and a mold element, wherein the pipe and the cover are integrally formed and one single component as a with-cover pipe member, the inner connector and the outer connector are integrally formed and an other single component as a connector member, the connector member is partially inserted in the axial direction radially inside the pipe of the with-cover pipe member and connected with the pipe, each of the with-cover pipe member, the connector member, the moving core, and the housing is formed of a magnetic material, the cover and the housing accommodate the coil via the mold element, and the cover is abutted to a bottom portion of the housing in the axial direction.

2. The fuel injection valve according to claim 1, wherein the with-cover pipe member is formed by press-forming or forging.

3. The fuel injection valve according to claim 1, wherein the pipe of the with-cover pipe member has a valve-accommodating portion, which accommodates the valve member, the valve-accommodating portion has a fitting portion, which is dented in a radial direction and configured to be fitted with an annular sealing member, the pipe has a rear-side portion at a rear side of the fitting portion, the rear-side portion has a thickness t1, the cover has a thickness t2, and the thicknesses t1, t2 satisfy $t1 \leqq t2$.

4. The fuel injection valve according to claim 3, wherein the thickness t2 of the cover of the with-cover pipe member is greater than or equal to 1.5 mm.

5. The fuel injection valve according to claim 3, wherein the thickness t1 of the pipe of the with-cover pipe member is greater than or equal to 1 mm.

6. The fuel injection valve according to claim 1, wherein the housing, the with-cover pipe member, the moving core, the connector member, and the with-cover pipe member define a magnetic circuit, and the magnetic circuit therethrough flowing magnetic flux, and the moving core and the inner connector therebetween generate the magnetic attraction force, in response to energization of the coil and generation of the magnetic field.

7. The fuel injection valve according to claim 1, wherein the cover extends in a radial direction from an outer circumferential periphery of the pipe, the cover extends in a circumferential direction around the outer circumferential periphery of the pipe, and the cover is substantially in a collar shape.

8. The fuel injection valve according to claim 1, wherein the bottom portion of the housing in the axial direction is radially protruded inward to define a tapered surface, and a portion of the cover is tapered and fitted to the bottom portion of the housing in the axial direction.

9. The fuel injection valve according to claim 8, wherein the mold element is formed of resin.

10. The fuel injection valve according to claim 9, further comprising:

an electrical connector having a terminal connected with the coil via a wiring member, wherein the mold element and the electrical connector are integrally formed from resin.

11. The fuel injection valve according to claim 10, wherein the coil is substantially in a cylindrical shape and has an outer circumferential periphery and an inner circumferential periphery both being covered with the mold element.

12. The fuel injection valve according to claim 11, wherein the coil surrounds throughout the outer circumferential periphery of the pipe in the circumferential direction.

* * * * *